US011052629B2

(12) United States Patent
Borgström et al.

(10) Patent No.: US 11,052,629 B2
(45) Date of Patent: Jul. 6, 2021

(54) APPARATUS AND METHOD FOR FILLING A POUCH TYPE PACKAGE

(71) Applicant: Ecolean AB, Helsingborg (SE)

(72) Inventors: Magnus Borgström, Helsingborg (SE); Lennart Friberg, Trelleborg (SE)

(73) Assignee: ECOLEAN AB, Helsingborg (SE)

( * ) Notice: Subject to any disclaimer, the term of this patent is extended or adjusted under 35 U.S.C. 154(b) by 389 days.

(21) Appl. No.: 15/556,832

(22) PCT Filed: Mar. 9, 2016

(86) PCT No.: PCT/EP2016/054997
§ 371 (c)(1),
(2) Date: Sep. 8, 2017

(87) PCT Pub. No.: WO2016/146445
PCT Pub. Date: Sep. 22, 2016

(65) Prior Publication Data

US 2018/0050512 A1 Feb. 22, 2018

(30) Foreign Application Priority Data

Mar. 13, 2015 (EP) ..... 15158940

(51) Int. Cl.
*B31B 70/86* (2017.01)
*B65B 31/04* (2006.01)
(Continued)

(52) U.S. Cl.
CPC ..... *B31B 70/872* (2017.08); *B31B 70/642* (2017.08); *B65B 31/048* (2013.01);
(Continued)

(58) Field of Classification Search
CPC ..... B65B 31/048; B65B 43/465; B65B 61/14; B65B 31/046; B65B 31/047; B65B 43/56; B31B 70/872; B31B 70/642; B31B 70/008
(Continued)

(56) References Cited

U.S. PATENT DOCUMENTS 3,730,240 A * 5/1973 Presnick ..... B65D 81/052 383/3
4,000,029 A * 12/1976 Michaels ..... B29C 65/242 156/510
(Continued)

FOREIGN PATENT DOCUMENTS

EP 0999137 A2 5/2000
EP 2746169 A1 6/2014
(Continued)

OTHER PUBLICATIONS

International Search Report and Written Opinion from International Application No. PCT/EP2016/054997 dated Jun. 13, 2016, 2 pages.

*Primary Examiner* — Robert F Long
*Assistant Examiner* — Eduardo R Ferrero
(74) *Attorney, Agent, or Firm* — Brundidge & Stanger, P.C.

(57) ABSTRACT

An apparatus for filling a pouch type package with a liquid product, comprising a plurality of stations arranged to consecutively receive and handle the pouch type package, the plurality of stations comprising a filling station for filling the product compartment with the liquid product, a sealing station for sealing the product compartment and comprising a first sealing member arranged to provide the pouch type package with a first seal closing the filling duct, a gas filling station arranged to introduce gas into the handle compartment, and a transfer unit comprising a gripping member for retrieving the package from the gas filling station and
(Continued)

transferring it to a neighboring down-stream situated station. A gas sealing unit (36) integrated in the gripping member of the transfer unit, the gas sealing unit (36) comprising a second sealing member (37) arranged to provide the pouch type package with a second seal entrapping gas introduced into the handle compartment. The invention also relates to a method for filling a pouch type package.

14 Claims, 8 Drawing Sheets

(51) Int. Cl.
*B65B 43/46* (2006.01)
*B65B 61/14* (2006.01)
*B31B 70/64* (2017.01)
*B31B 70/00* (2017.01)
*F17C 5/06* (2006.01)

(52) U.S. Cl.
CPC ..... *B65B 43/465* (2013.01); *B65B 61/14* (2013.01); *B31B 70/008* (2017.08); *F17C 5/06* (2013.01)

(58) Field of Classification Search
USPC ..... 53/413, 404, 79, 80, 134.1, 403, 279, 53/250, 251, 469, 294.7
See application file for complete search history.

(56) References Cited

U.S. PATENT DOCUMENTS 4,216,639 A * 8/1980 Gautier ..... B65B 9/093 53/413
4,377,192 A * 3/1983 Gautier ..... B65D 75/52 383/7
4,423,583 A * 1/1984 Carey ..... B65B 43/465 493/206
4,986,804 A * 1/1991 Jensen ..... B29C 66/80 156/583.1
6,050,061 A * 4/2000 Todd ..... B65B 43/465 53/201
6,195,967 B1 * 3/2001 Todd ..... B29C 65/18 53/139.2
7,464,520 B2 * 12/2008 Nishi ..... B31D 5/0073 53/403
2004/0035865 A1 * 2/2004 Rosen ..... B65D 33/02 220/4.01
2007/0041669 A1 * 2/2007 Rosen ..... B65D 75/008 383/104
2007/0068118 A1 * 3/2007 Forss ..... B65D 75/563 53/403
2007/0089377 A1 * 4/2007 Yasuhira ..... B65B 43/465 53/403
2008/0209854 A1 * 9/2008 Gustafsson ..... B65B 61/14 53/79
2008/0276645 A1 * 11/2008 Murray ..... B65B 43/465 62/530
2009/0000692 A1 * 1/2009 Gustafsson ..... B65B 39/08 141/114
2009/0078337 A1 * 3/2009 Gustafsson ..... B65B 39/004 141/313
2010/0037987 A1 * 2/2010 Gustafsson ..... B65B 1/42 141/105
2010/0242413 A1 * 9/2010 Gustafsson ..... B65B 61/14 53/469
2013/0160400 A1 * 6/2013 Decio ..... B65B 1/04 53/284.7
2014/0033649 A1 * 2/2014 Ishikawa ..... B65B 1/04 53/405
2014/0182244 A1 * 7/2014 Kawamura ..... B65B 31/048 53/284.7
2014/0325938 A1 * 11/2014 Yoshikane ..... B65B 31/00 53/79
2014/0328551 A1 * 11/2014 Nevo ..... B65D 33/00 383/3
2015/0328855 A1 * 11/2015 Honda ..... B29C 66/43121 53/403
2016/0016693 A1 * 1/2016 Yoshikane ..... B65B 43/36 53/492

FOREIGN PATENT DOCUMENTS

JP 489404 U 2/1973
WO 2009041911 A1 4/2009

* cited by examiner

APPARATUS AND METHOD FOR FILLING A POUCH TYPE PACKAGE

FIELD OF THE INVENTION

The present invention relates to an apparatus and a method for filling a pouch type package, and more specifically filling such a package comprising a handle compartment adapted to be filled with gas.

BACKGROUND ART

It has become increasingly common to package liquid products, in particular liquid food products such as water, milk, juice or wine, in pouch type packages, also referred to as packages of a collapsible type.

By a pouch type package is meant a container having a compartment which is defined by flexible walls and whose volume is dependent on the relative position of the walls. The pouch type package may be of stand-up pouch type having two opposing side walls and a bottom wall.

It is known to manufacture webs consisting of interconnected packages of the type described above rolled onto a bobbin and to arrange such a roll in a filling machine. The web is then fed to the filling machine where the packages are separated from the web and subsequently filled with contents and sealed.

The packages may be provided with a handle compartment adapted to be filled with gas. The gas filled handle compartment provides rigidity to the package and also forms a handle enabling a user to conveniently manage the package.

EP1 7801 29 discloses a filling machine for a pouch type package having a handle compartment adapted to be filled with gas. The filling machine is of a rotary type having a turning table provided with grippers about its periphery. The packages are suspended in the grippers an intermittently conveyed to a plurality of stations, such as a bag mouth opening station, a filling station, a gas filling station and a sealing station for the product compartment and the handle.

EP220081 7 discloses another type of filling machine for a pouch type package. The filling machine disclosed therein comprises a section through which the packages are fed intermittently by means of an array of cyclic movable grippers in a broad wise direction to a plurality of stations such as a filling duct opening station, a filling station, a sealing station for the product compartment, a gas filling station and a sealing station for the handle.

The provision a pouch type package having a handle compartment adapted to be filled with gas consequently requires that the filling machine is equipped with means for enabling the gas filling operation. This may result in that the filling machine becomes bulky, and there thus exists a need for a more compact filling machine capable of gas filling a handle compartment of the pouch type package.

SUMMARY OF THE INVENTION

In view of that stated above, the object of the present invention is to provide an improved apparatus and method for filling a pouch type package having a handle compartment adapted to be filled with gas.

It is also an object to provide such an apparatus and method enabling an improved utilization of space.

To achieve at least one of the above objects and also other objects that will be evident from the following description, a device having the features defined in claim 1 and a method having the features defined in claim 9 are provided according to the present invention. Preferred embodiments of the device and method will be evident from the dependent claims.

More specifically, there is provided according to a first aspect of the present invention an apparatus for filling a pouch type package with a liquid product, the pouch type package comprising two flexible opposing side walls defining a product compartment communicating with the environment via a filling duct and a separate handle compartment communicating with the environment via a gas inlet arranged in one of the two side walls, wherein the product compartment is adapted to be filled with the liquid product through the filling duct and wherein the handle portion is adapted to be filled with gas through the gas inlet, the apparatus comprising a plurality of stations arranged to consecutively receive and handle the pouch type package, the plurality of stations comprising a filling station for filling the product compartment with the liquid product and comprising a filling tube insertable into the filling duct of the pouch type package, a sealing station for sealing the product compartment after having been filled with the liquid product and comprising a first sealing member arranged to provide the pouch type package with a first seal closing the filling duct, a gas filling station arranged to introduce gas into the handle portion for inflation thereof and comprising a nozzle applicable over the gas inlet, and a transfer unit comprising a gripping member for retrieving the package from the gas filling station and transferring it to a neighboring downstream situated station. A gas sealing unit is integrated in the gripping member of the transfer unit, the gas sealing unit comprising a second sealing member arranged to provide the pouch type package with a second seal entrapping gas introduced into the handle compartment.

Hereby an improved apparatus for filling a pouch type package is provided. Since the gas sealing unit is integrated in the gripping member of the transfer unit, the conventional gas sealing station situated down-stream of the gas filling station may be dispensed with. As a consequence, the apparatus may be made more compact enabling an improved utilization of space. Further, commencing sealing of the handle compartment immediately when the package is retrieved from the gas filling station and completing the sealing during the transfer to the neighboring down-stream situated station makes the conventional step of blocking the gas filled handle compartment while the package is being moved to a gas sealing station unnecessary which eliminates the risk of gas leaking out of the handle compartment.

According to an embodiment of the inventive apparatus, the gripping member of the transfer unit may comprise a pair of jaws arranged to pinch an upper portion of the pouch type package for retrieval thereof. The pair of jaws may comprise a first jaw having a thermally non-conductive engagement member, wherein the second sealing member is recessed in an engagement surface of the engagement member. Hereby it is ensured that a well defined second seal may be provided by the second sealing member. The engagement surface may comprise a an first engagement portion adjoining the second sealing member, the first engagement portion being arranged to face the pressurized side of the handle compartment while the second sealing member engages the package in order to provide the second seal. Hereby it is ensured that the second seal in not exposed while being formed to the pressurized gas inside the handle compartment.

According to another embodiment of the inventive apparatus, the transfer unit may comprise an additional gripper arranged to transfer the pouch type package from a station situated up-stream or down-stream of the gas filling station to a neighboring down-stream situated station. The provision of a transfer unit comprising additional grippers facilitates synchronized transfer of packages from up-stream situated stations to down-stream situated stations.

According to yet another embodiment of the present invention, the sealing station and the gas filling station may be separate stations or integrated in a single station.

According to yet another embodiment, each of the plurality of stations may be arranged for parallel handling of a group of packages comprising at least two pouch type packages. Parallel handling of packages may increase the production capacity of the inventive apparatus. The gripping member of the transfer unit may in this context be arranged to grip an upper back portion comprising said inlet of the package as well as an upper front portion of a package being handled in parallel. The use of a single gripping member for engagement with two packages handled in parallel may improve the compactness of the apparatus.

According to another aspect of the present invention, a method for filling a pouch type package with a liquid product is provided, the pouch type package comprising two flexible opposing side walls defining a product compartment communicating with the environment via a filling duct and a separate handle compartment communicating with the environment via a gas inlet arranged in one of the two side walls, wherein the product compartment is adapted to be filled with the liquid product through the filling duct and wherein the handle portion is adapted to be filled with gas through the gas inlet, the method comprising filling the product compartment with a liquid product at a filling station in which a filling pipe is inserted into the filling duct of the pouch type package, transferring the pouch type package with its product compartment filled with a liquid product from the filling station to a sealing station, providing the pouch type package with a first seal closing the filling duct at the sealing station, transferring the package from a neighboring up-stream situated station to a gas filling station, introducing gas into the handle compartment for inflation thereof at the gas filling station by means of a nozzle applied over the gas inlet of the pouch type package, and providing the pouch type package with a second seal entrapping gas introduced into the handle compartment at the gas filling station. The method further comprises transferring the package from the gas filling station to a neighboring down-stream situated station, wherein the step of providing the pouch type package with a second seal is performed by means of a gas sealing unit integrated in a gripping member of a transfer unit during the step of transferring the package from the gas filling station to the neighboring down-stream situated station.

According to an embodiment of the inventive method, the neighboring up-stream situated station from which the pouch type package is transferred to the gas filling station may be the sealing station.

According to another embodiment, the neighboring down-stream situated station to which the pouch type package is transferred from the gas filling station may be an output station.

According to yet another embodiment, the second seal may be provided such on the pouch type package that in extends across a third segment of the handle compartment, the third segment being arranged between a first segment of the handle compartment forming a handle in the inflated state of the handle compartment and a second segment comprising said inlet.

The details and advantages of the second aspect of the invention are largely analogous to those of the first aspect of the invention, wherein reference is made to the above.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
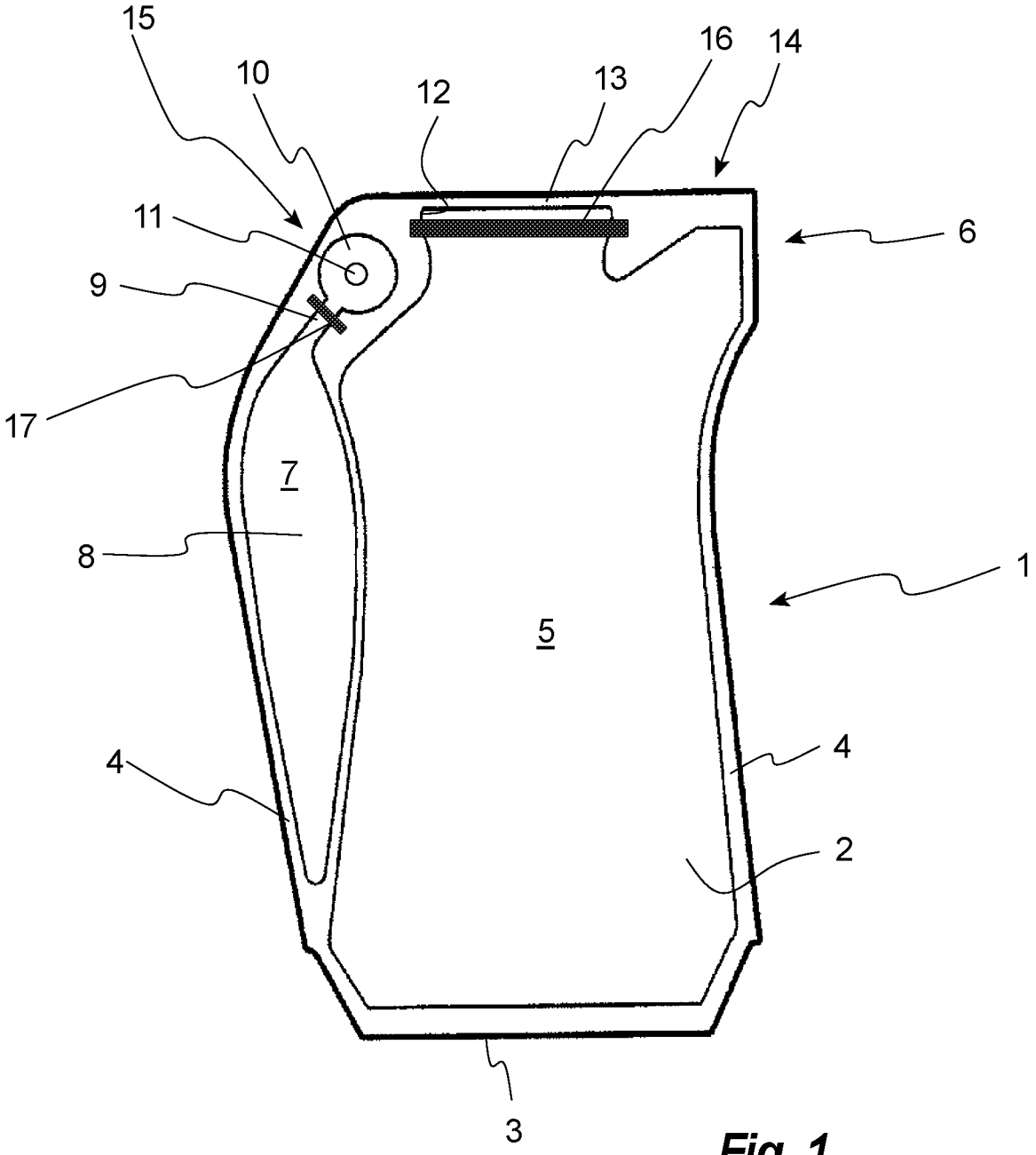
FIG. 1 is a plan view of a pouch type package for use together with the inventive apparatus and method.

With reference to FIG. 1, an example of a pouch type package 1 in the form of a stand-up pouch is shown to which the device and method in accordance with the present invention may be applied. The pouch type package may be used as a pre-made package adapted to be filled and sealed in a filling machine. Alternatively, the package may be produced fully or in part in the filling machine. The pouch type package may also be referred to as a package of collapsible type.

The pouch type package is especially intended for products in the form of liquid foodstuffs such as milk, water, fruit drinks, juice or wine, but it may, of course, also be intended for products in some other form or for other purposes.

The pouch type package disclosed comprises three flexible walls, two of which constitute side walls 2 and the third constitutes a bottom wall 3. The walls are joined along connecting portions 4 to define a product compartment 5. The walls 2,3 are made of a bendable and flexible material, which means that the volume of the product compartment 5 depends on the relative distance between the walls 2,3. The volume of the product compartment 5 is thus directly dependent on the filling ratio of the package 1. In other words, the package is of a collapsible type.

The walls 2,3 of the package 1 are preferably joined in the connecting portions 4 by welding or sealing. Also other methods of joining, such as gluing, are conceivable.

The shown package 1 has at its upper front end an opening portion 6 which is formed as a spout. To open the container 1, an outer end of the opening portion 6 is separated, thereby making the product compartment 5 communicate with the environment. The outer end can be separated, for example, by cutting or tearing off. The package 1 may thus in its filled state be emptied in a pouring motion like when handling a jug. The contents of the package may of course be consumed in other ways, for example by means of a straw inserted through the spout of the package or through the side wall of the package.

The package material may be a multilayered plastic film material and may comprise a core layer of mineral-based filler and a binder of polyolefin. It will be appreciated that also other materials and layers are possible, such a gas barrier layer or a light barrier layer.

At the rear end of the pouch type package 1, a handle compartment 7 intended to be filled with gas in order to form a handle is shown. The handle compartment 7 is defined by the two side walls 2 and a peripheral connecting portion 4.

The handle compartment 7 is divided into three segments which all communicate with each other. The first segment 8 comprises the part that is intended to form the actual handle. The first segment 8 thus is the segment which in the completed package gives the desired function. A third segment 9 is directly connected to the first segment 8 and constitutes a narrow duct. A second segment 10 is directly connected to the third segment 9. The second segment 10 consists in its simplest form of an area defined by a portion of the two opposed side walls 2 with an inlet 11 in the form of a hole in one side wall 2. The inlet 11 thus constitutes an entry to the handle compartment 7, through which inlet 11 the handle compartment 7 communicates with the environment before being filled with gas and sealed.

As mentioned above, the third segment 9 constitutes a narrow duct. Its main function is to form a surface over which a means for sealing of the duct after completion of the gas filling can be arranged. The cross-sectional area of the third segment 9 is significantly smaller than the cross-sectional area of the first segment 8. By cross-sectional area is in this case meant the area that can be made up by the side walls between them transversely to the longitudinal direction of the duct.

The third 9 and the second segment 10 of the handle compartment 7 may on their insides be provided with an embossed surface (not shown). The embossed surface may facilitate separation of the associated side wall portions in connection with gas filling.

The handle compartment 7 with the three segments 8, 9, 10 is in the shown embodiment oriented in such a manner that the second segment 10 is arranged adjacent to the upper back portion 15 of the container 1. However, it will be appreciated that the handle compartment 7 can be arranged as desired.

As mentioned above, the handle compartment 7 is intended to be filled with gas in order to form a handle of the container. By gas is preferably meant air, but of course also other gases may be used. The handle compartment 7 has such a geometry and filling ratio as to form an easy-to-grip handle in inflated state. Such a handle may also promote by its geometry and gas filling a considerable rigidity of the container 1.

The package 1 has centrally in its upper part a filling duct 12 through which the product compartment 5 of the package 1 may be filled with a product. When the package 1 is provided as a blank, as in the shown embodiment, for a filling machine, the filling duct 12 may be closed by an end closure 13 which has to be removed prior to filling. After completion of the filling, the filling duct 12 is once more sealed with a first seal indicated at 16.

The handle compartment is as described above intended to be sealed after inflation thereof which is illustrated by a second seal indicted at 17. The pouch type package may be supplied to a filling machine in a pre-made state and included in a web consisting of interconnected packages. The web may be wound up on a bobbin. The web may be fed into the filling machine, where the packages are separated from the web and filled.

The packages may initially be fed in an edge wise direction while the end closure 13 is removed and the packages are separated. The feeding in the edge wise direction may be intermittent or continuously.

After removal of the end closure 13 and separation of the packages, the packages may be fed in a broad wise direction in a section of the filling machine intended for filling of the package 1. The feeding in broad wise direction may be intermittent. For the feeding in the broad wise direction, a transfer unit may be provided and arranged for gripping the package in an upper front portion indicated at 14 and in the upper back portion indicated at 15.

Figure 2:
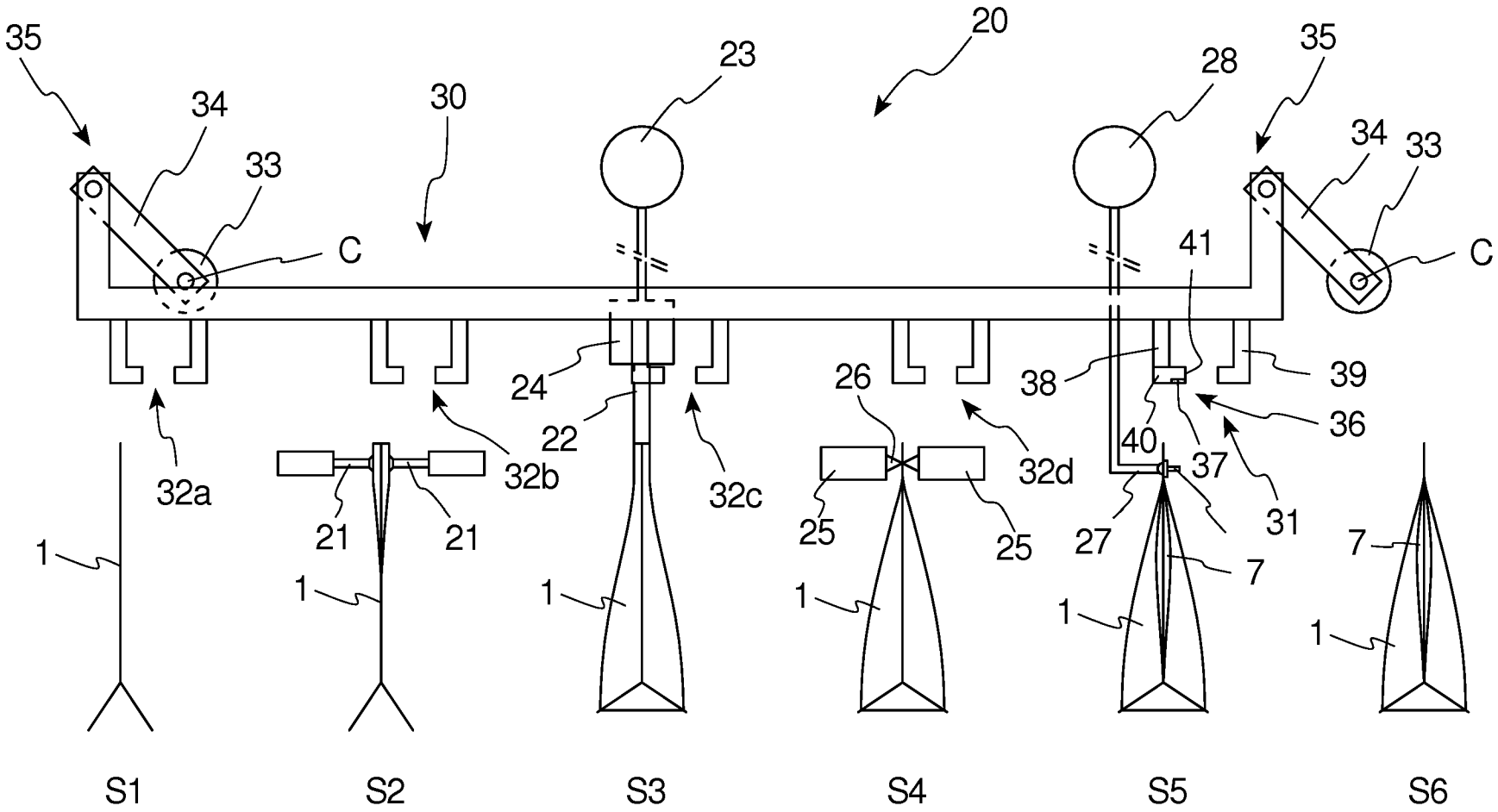
FIG. 2 is a schematic side view of an embodiment of the inventive apparatus.

In FIG. 2, to which reference now is made, an apparatus 20 according to an embodiment of the present invention for filling a pouch type package 1 is schematically shown. The shown embodiment of the inventive apparatus 20 represents such a section described above intended for filling of packages being intermittently fed in a broad wise direction.

The inventive apparatus 1 may comprise a plurality of stations, each of which may comprise not shown grippers for holding the package at the associated station. It should be realized that the stations may be integrated in the grippers.

In the shown embodiment, the plurality of stations comprises: an input station S1 for receiving packages fed to the apparatus, for instance from a section of the filling machine in which section the packages have been fed in an edge wise direction; an opening station S2 for opening-up of the filling duct of the packages; a filling station S3 for filling of the product compartment of the packages; a sealing station S4 for sealing the filled product compartment of the packages; a gas filling station S5 for inflating the handle compartment of the packages; and an output station S6 form which the packages is transferred for subsequent handling. A package 1 of the type described above with reference to FIG. 1 is shown at each station.

The opening station S2 may comprise a pair of suction cups 21 arranged to engage the opposing side wall portions defining the filling duct 12 and to separate the opposing side wall portions by separation of the suction cups 21.

The filling station S3 may comprise a filling tube 22 which is connected to a liquid product source 23 via a product valve 24. The filling tube 22 is insertable into the filling duct 12 of the package 1 once the filling duct 12 has been opened-up in the preceding opening station S3.

The sealing station S4 may comprise a pair of sealing jaws 25, of which at least one comprises a first sealing member 26, which may be permanently heated. The sealing jaws 25 may be arranged to engage a package 1 situated at the sealing station S3 such that the first sealing member 26 provides the package with the first seal 16 closing the filling duct 12 once the product compartment 5 has been filled in the preceding filling station S3 and thereby to seal the product compartment 5. The sealing jaws 25 may be integrated in, or form, the gripper holding the package 1 at the sealing station S4.

The gas filling station S5 comprises in the shown embodiment a nozzle 27 connected to a source 28 of pressurized gas and an abutment 29 against which the nozzle 27 is movably arranged in order to clamp a package 1 and to apply the nozzle 27 over the inlet 11 of the handle compartment 7. The nozzle 27 and the abutment 29 may be integrated in the gripper holding the package at the gas filling station S5.

It should be realized that the stations may be designed differently and since the specific design of the stations is not the focus of the present invention; these stations will not be described in detail.

The inventive apparatus 20 further comprises a transfer unit 30. The shown embodiment of the transfer unit 30 is arranged to transfer the packages 1 intermittently in a broad wise direction in the direction indicated by arrow P1 and are arranged for gripping the packages 1 in the upper front portion 14 and in the upper back portion 15.

The transfer unit comprises a gripping member 31 for retrieving a package 1 from the gas filling station S5 and transferring it to a neighboring down-stream situated station, which in the shown embodiment is the output station S6.

In the shown embodiment, the transfer unit 30 further comprises additional grippers arranged to retrieve and transfer packages from stations situated up-stream of the gas filling station S5 to a neighboring down-stream situated station.

Thus, in the shown embodiment, the additional grippers comprise a first additional gripper 32*a* for retrieving a package 1 from the input station S1 and transferring it to the opening station S2; a second additional gripper 32*b* for retrieving a package 1 from the opening station S2 and transferring it to the filling station S3; a third additional gripper 32*c* for retrieving a package 1 from the filling station S3 and transferring it to the sealing station S4; and a fourth additional gripper 32*d* for retrieving a package 1 from the sealing station S4 and transferring it to the gas filling station S5.

The transport unit 30 is carried by rotatable mounts 33. Each mount 33 comprises an arm 34, which at its end 35 facing away from the centre of rotation C of the mount 33 is pivotally carried in bearings in the transport unit 30. This allows a circular motion to be imparted to the transport unit 30 and, more specifically, each of the additional grippers 32*a-d* and the gripping member 31 to be cyclically moved along a circular, endless path between a pick-up position and delivery position.

Each of the gripping member 31 and the additional grippers 32*a-d* may comprise a pair of jaws 42*a-d* which jaws are movable against each other in order to pinch the upper back portion 15 of the package. Additional pairs of jaws (not shown) may be arranged to pinch the upper front portion 14 of the package.

The transfer unit 30 may for instance comprise pneumatic, hydraulic and/or mechanic means (not shown) for operation of the pairs of jaws. In the figure, the pairs of jaws are shown in an open position.

The gripping member 31 may further comprise a gas sealing unit 36 integrated therein. The gas sealing unit 36 comprises a second sealing member 37 arranged to provide the pouch type package 1 with a second seal 17 entrapping gas introduced into the handle compartment 7 which gripping member 31 retrieves and transfers the package 1 from the gas filling S5 station to the neighboring down-stream situated station which in the shown embodiment is the output station S6.

The pair of jaws 38, 39 of the gripping member 31 may comprise a first jaw 38 having a thermally non-conductive engagement member 40 which for instance may be made of polyether ether ketone (PEEK). The engagement member 40 defines an engagement surface 41 in which the second sealing member 37 is recessed. The second sealing member 37 is located such in the engagement surface 41 that the second seal 17 provided by the second sealing member 37 when the jaws 38, 39 of the gripping member 31 pinches the upper back portion 15 of the package 1 extends across the third segment 9 of the handle compartment 7.

Hereafter, the operation of the transfer unit 30 will be described with reference to FIGS. 3*a*-3*d*.

Figure 3A:
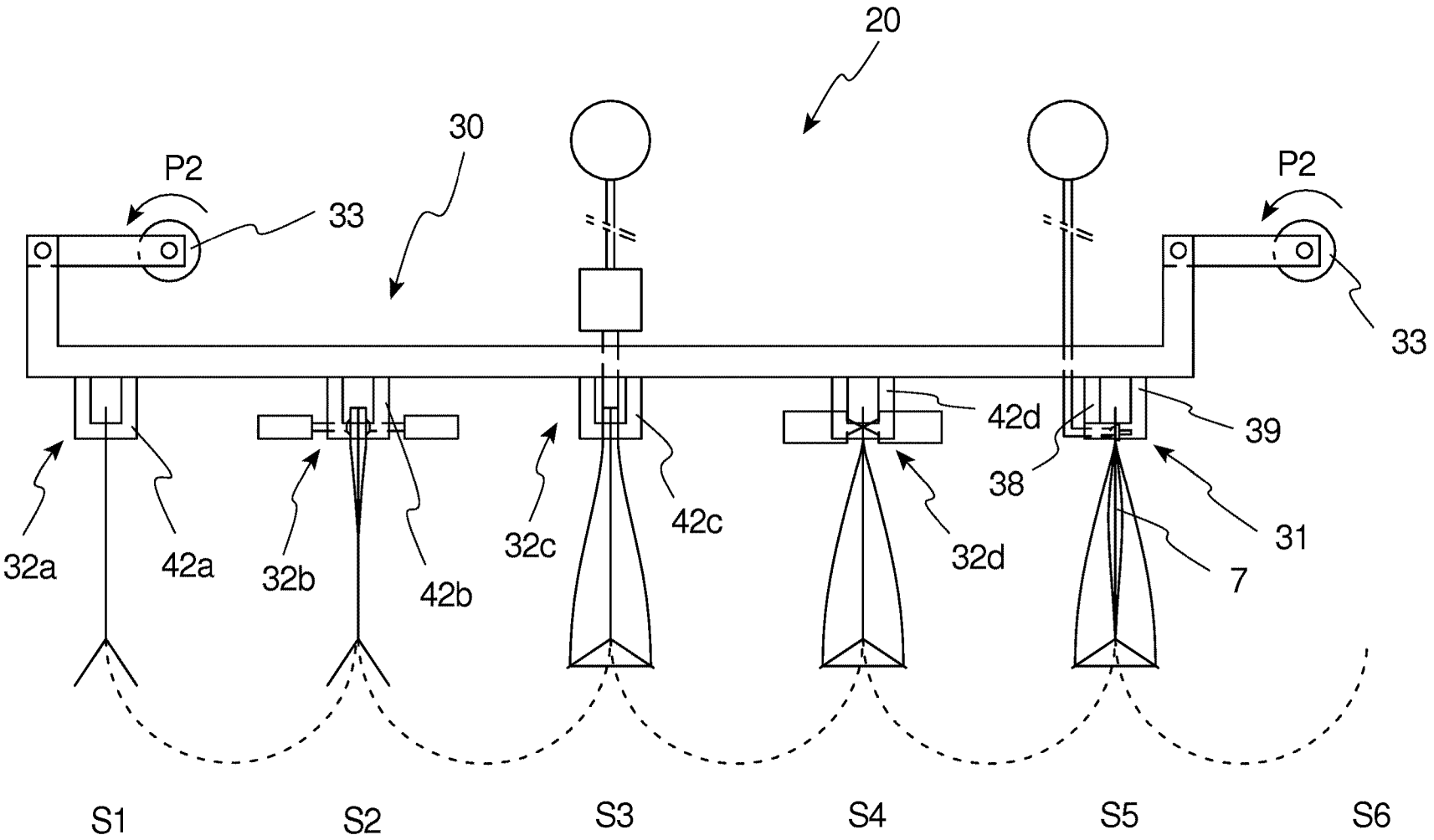
FIGS. 3*a*-3*d* is schematic side views illustrating the operation of the apparatus shown in FIG. 2.

In FIG. 3*a*, the transfer unit 30 has been operated by rotation of the mounts 33 such that additional grippers 32*a-d* and the gripping member 31 have been brought along a respective circular path to the associated u p-stream station. Also, the pairs of jaws have been moved to a closed position in order to pinch an upper back portion 15 of the package 1 located at the respective station. As mentioned above, additional pairs of jaws (not shown) are provided for pinching the upper front portion 14 of the packages 1.

Thus, the pair of jaws 42*a* of the first additional gripper 32*a* has retrieved an unfilled package provided in a flat state 1 and located at the input station S1; the pair of jaws 42*b* of the second additional gripper 32*b* has retrieved a package 1 having an opened-up filling duct 12 and located at the opening station S2; the pair of jaws 42*c* of the third additional gripper 32*c* has retrieved a package 1 having been filled with liquid contents and located at the filling station S3; the pair of jaws 42*d* of the fourth additional gripper 32*d* has retrieved a package 1 having been provided with the first seal 16 closing the filling duct 12 and located at the sealing station S4; and the pair of jaws 38, 39 of the gripping member 31 has retrieved a package 1 having a gas filled handle compartment 7 and located at the gas filling station S5.

Figure 3B:
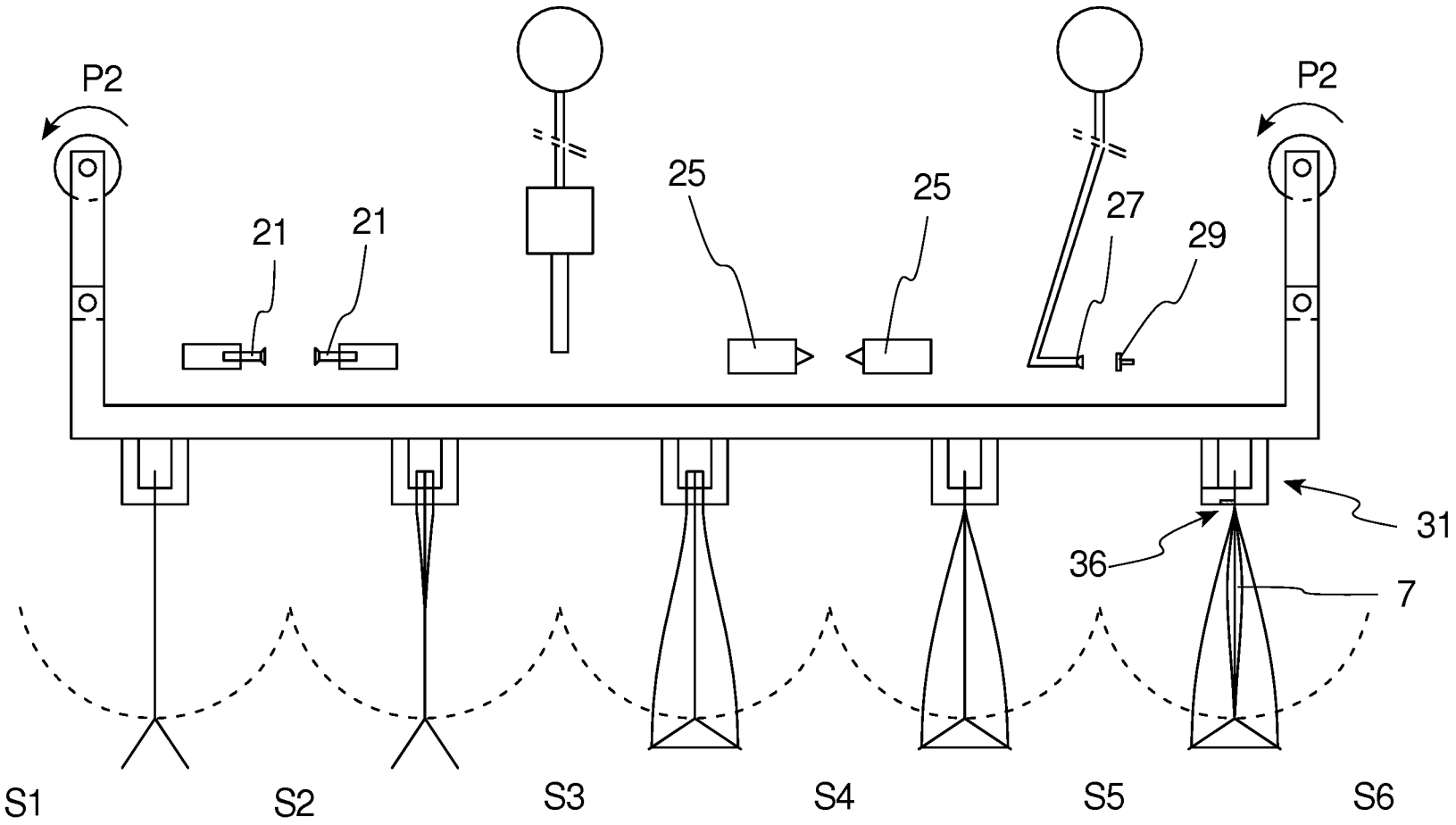

In FIG. 3*b*, the mounts 33 have been rotated in the direction indicated by arrows P2, whereby the each retrieved package 1 is being transferred towards the associated neighboring down-stream situated station along a respective circular path of movement. As indicated, the stations have been operated in order to allow the respective package to be retrieved and also to allow a new package to be received. Thus, the suction cups 21 have been deactivated and separated; the sealing jaws 25 have been separated; and the nozzle 27 has been separated from the abutment 29. As described above, while the gripping member 31 transfers the package 1 from the gas filling station S5 to the output station S6, the gas sealing unit 36 integrated in the gripping member 31 provides the package 1 with a second seal 17 entrapping gas introduced into the handle compartment 7.

Figure 3C:
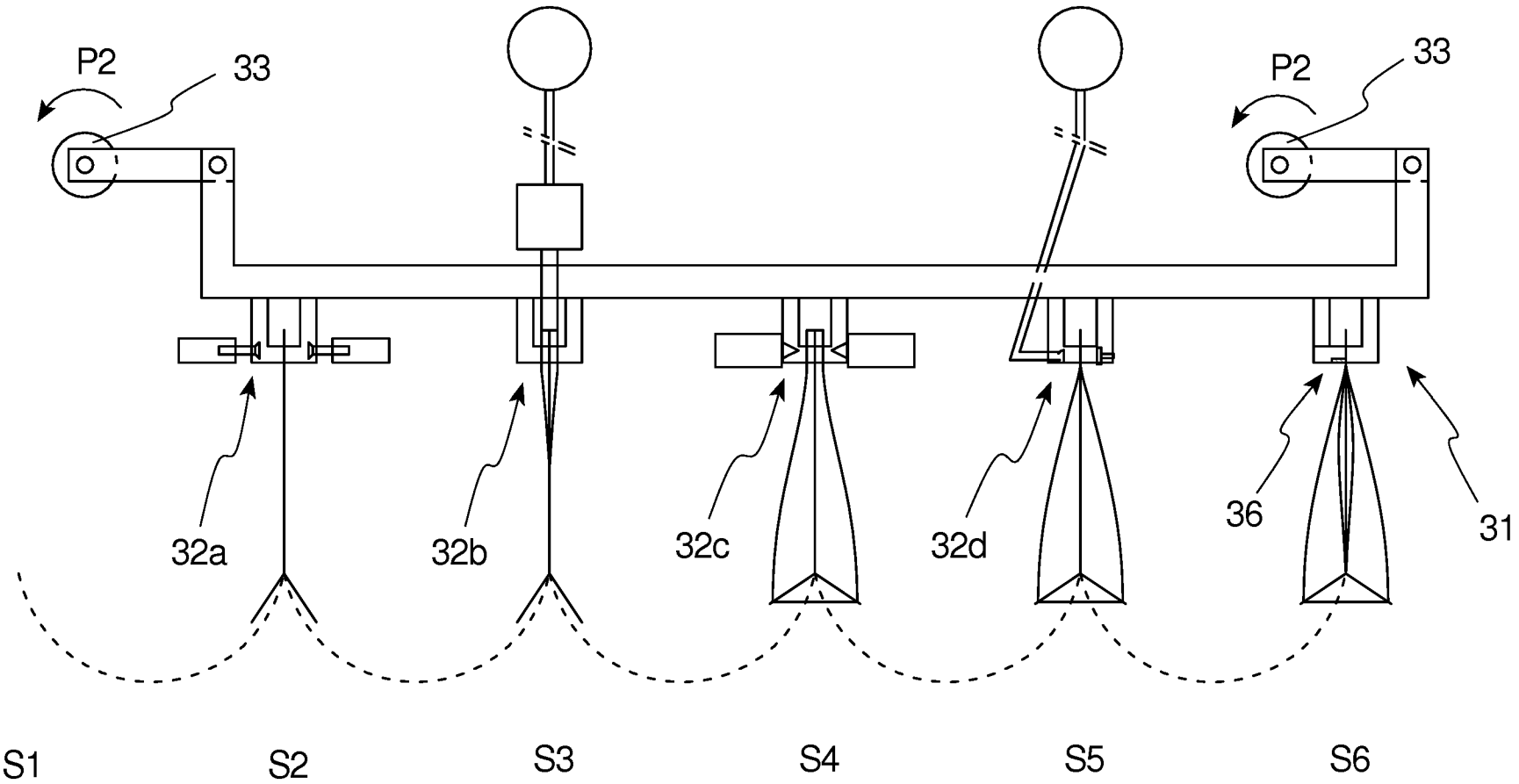

In FIG. 3*c*, the mounts 33 have been continuously rotated in the P2 direction in order to position the additional grippers 32*a-d* and the gripping member 31 at the associated down-stream situated stations. Thus, the first additional gripper 32*a* has been brought to the opening station S2; the second additional gripper 32*b* has been brought to the filling station S3; the third additional gripper 32*c* has been brought to the sealing station S4; the fourth additional gripper 32*d* has been brought to the gas filling station S5; and the gripping member 31 has been brought to the output station S6. At the respective station, the not shown grippers may then be activated for holding the package 1 transferred to the respective stations.

Further, the second seal 17 provided by the gas sealing unit 36 integrated in the gripping member 31 is completed when the package 1 transferred by said gripping member 31 reaches the output station S6.

When the not shown grippers have been activated for holding the packages at the respective stations, the additional grippers 32*a-d* and the gripping member 31 may be opened thereby completing the transfer and delivery of the associated packages.

Figure 3D:
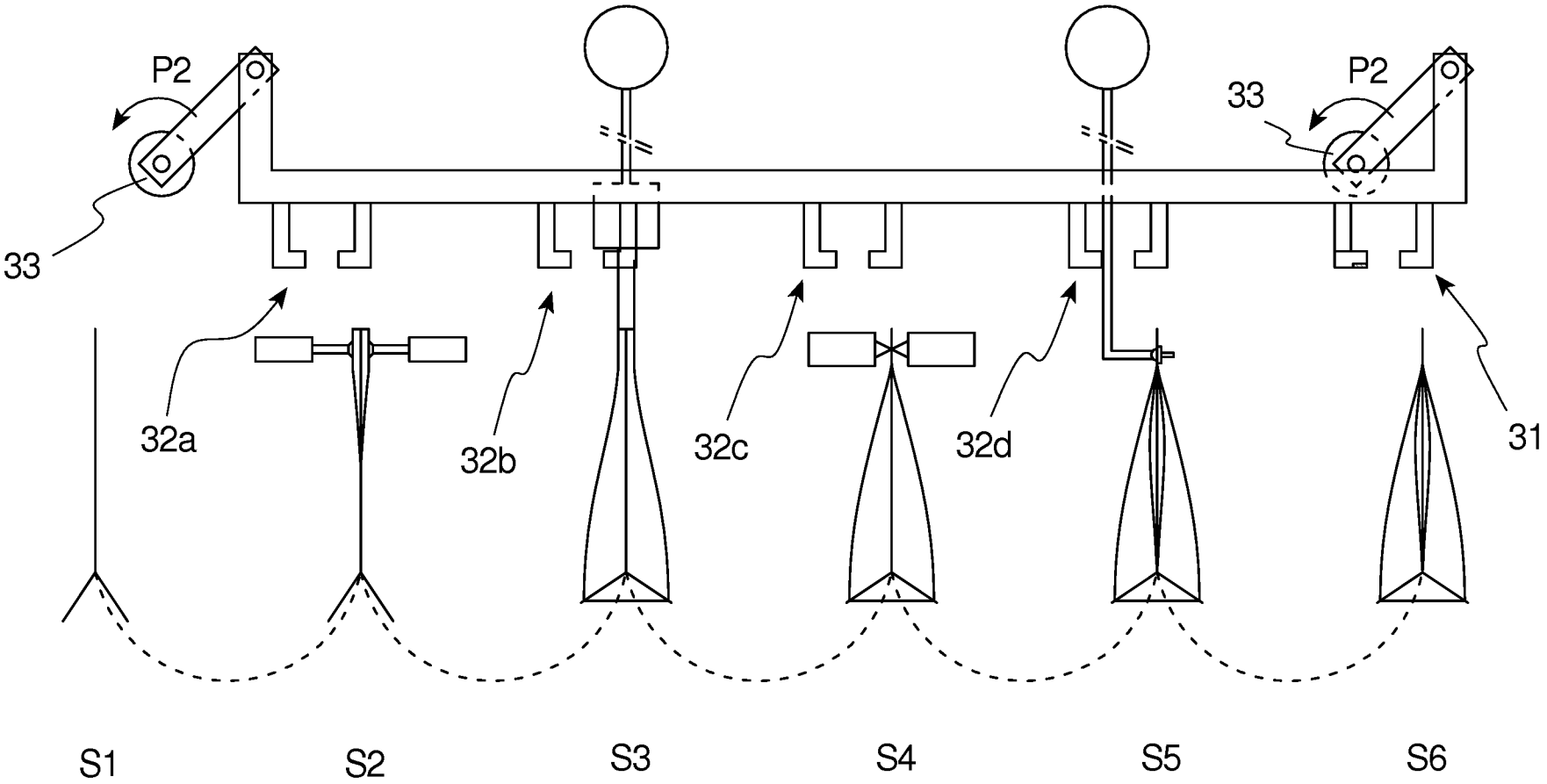

By continued rotation of the mounts in the P2 direction, as shown in FIG. 3*d*, the additional grippers 32*a-d* and the gripping member 31 may be moved towards the associated pick-up position in order to initiate a new retrieval-transfer-delivery cycle while the associated operation is carried out at the respective station. As seen, a new package a have been provided at the input station S1.

It should be realized that each station of the inventive apparatus may be arranged for parallel handling of two or more packages. Thus, the pairs of jaws of the additional grippers and the gripping member may be arranged to, in addition to pinching the upper back portion 15 of the packages 1 shown in FIGS. 3*a*-2*d*, also pinch the upper front portion 14 of a group of packages handled in parallel sections of the stations.

Figure 4:
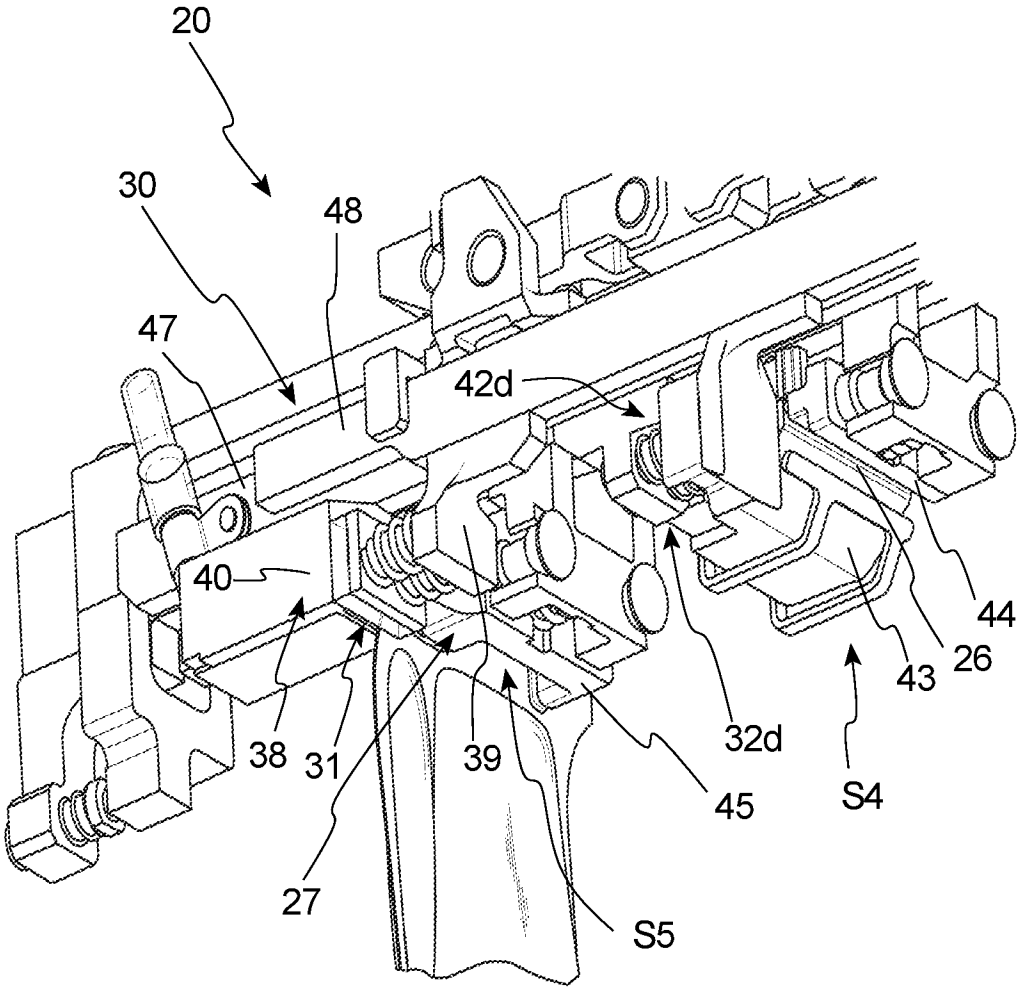
FIG. 4 is a perspective view of a part of an embodiment of the inventive apparatus.
Figure 5:
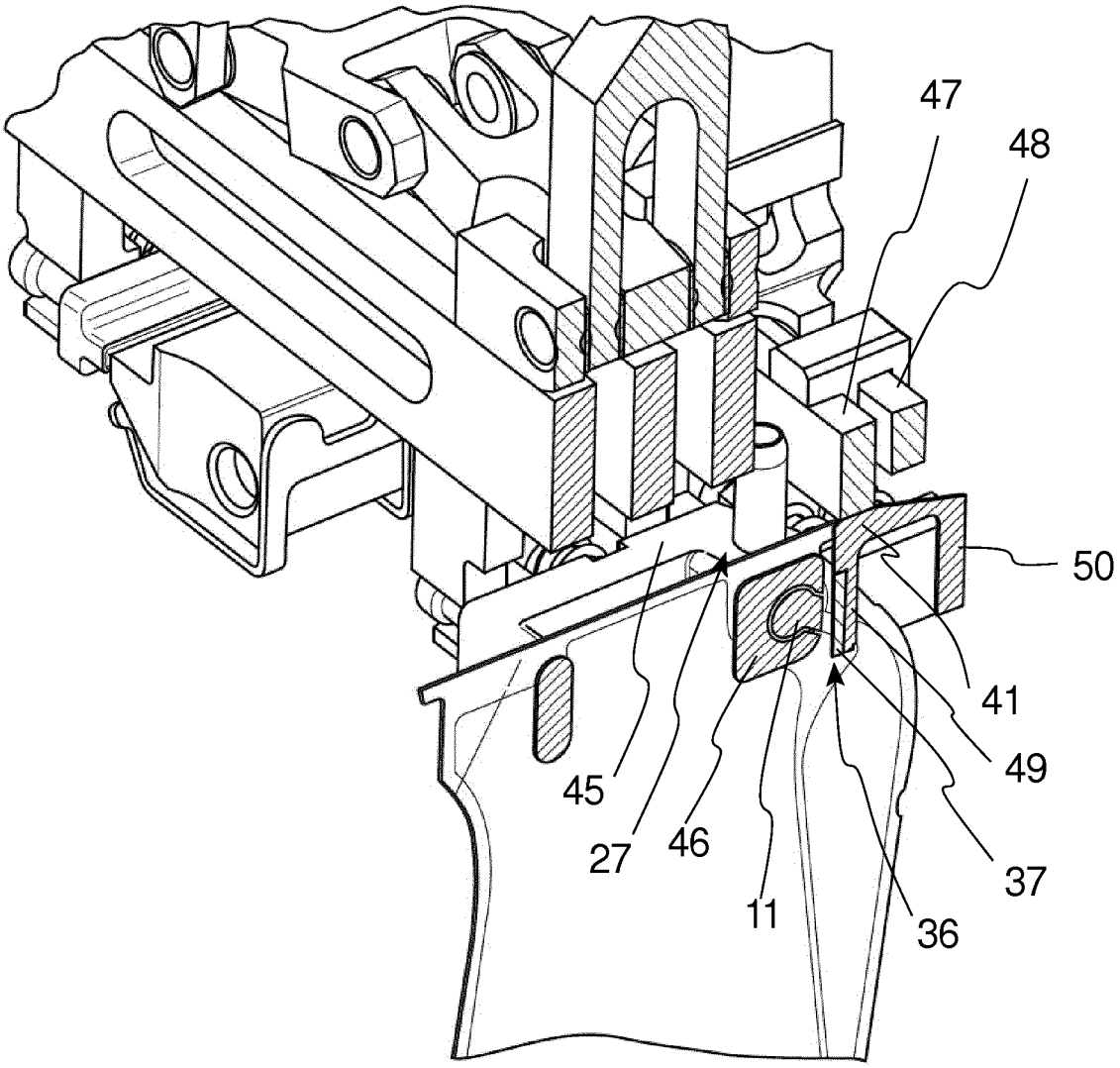
FIG. 5 is a partially sectioned perspective view of the apparatus shown in FIG. 4.

In FIGS. 4 and 5, to which reference now are made, a part of an embodiment of the inventive apparatus 20 is shown more in detail.

In the shown part of the apparatus 20, the sealing station S4 and the gas filling station S5 are illustrated as well as a part of transfer unit 30 comprising the fourth additional gripper 32*d* arranged for transferring a package 1 from the sealing station S4 to the gas filling station S5 and the gripping member 31 arranged for transferring a package 1 from the gas filling station S5 to a neighboring down-stream situated station. In the shown embodiment, the gripping member 31 and the fourth additional gripper 32*d* are arranged for pinching the upper back portion 15 of the packages 1, but it is understood that the transfer unit 30 also may arranged for pinching the upper front portion 14 of the packages 1 in order to establish a reliable grip of the packages 1. To this end the transfer unit may comprise an arrangement of gripping members and additional grippers corresponding to those that will be described below and arranged at the opposing side of the sealing station and gas filling station.

A pouch type package 1 is shown located at the gas filling station S5. No package is shown at the sealing station S4 for sake of clarity.

In the figures, the filling of gas into the handle compartment 7 has been completed, and the gripping member 31 has retrieved the package 1 by pinching the upper back portion 15 of the package 1. Subsequently, the grippers holding the packages at the stations will be opened and the transfer of the packages to a down-stream situated station will commence.

The sealing station S4 comprises two jaws 43, 44 having been brought together in order to provide a first seal 16 closing the filling duct 12 of the non-shown package. More specifically, the sealing station S4 comprises a first sealing member 26 integrated in at least a first jaw 43 of the jaws. The first sealing member 26 may be permanently heated. A second jaw 44 of the jaws may be an abutment jaw having a seal defining engagement section against which the first jaw 43 and the first sealing member 26 integrated therein are pressed. The pair of jaws 43, 44 also constitutes the gripper for holding the not shown package at the sealing station S4.

The gas filling station S5 comprises a gripper for holding the package in the form of a pair of jaws 45, 46 of which only the first jaw 45 is shown in the FIG. 4. In FIG. 5, the second jaw is indicated at 46. A nozzle 27 is integrated in the first jaw 45. The nozzle 27 is arranged such that it is positioned above the inlet 11 of the third section 9 of the handle compartment 7, which is clearly seen in the partially sectioned view shown in FIG. 5. The second jaw 46 of the pair of jaws forms an abutment against which the first jaw 45 and the nozzle 27 integrated therein are pressed during the gas filling operation.

The transfer unit 30 comprises in the shown embodiment a first and a second bar 47, 48 arranged in parallel and supporting the gripping member 31 and the fourth additional gripper 32*d*. The bars 47, 48 are connected to arms (not shown) rotatable by mounts (not shown) as disclosed above. Rotation of the arms by means of said mounts will move the fourth additional gripper 32*d* and the gripping member 31 from the sealing station S4 and the gas filling station S5, respectively, to the associated down-stream situated station, i.e. the gas filling station S5 and an output station (not shown), respectively.

The fourth additional gripper 32*d* comprises a pair of jaws 42*d*, wherein a first jaw of said pair of jaws 42*d* is supported by the first bar 47 and a second jaw of said pair of jaws 42*d* is supported by the second bar 48. Correspondingly, the gripping member 31 comprises a first jaw 38 supported by the first bar 47 and a second jaw 39 supported by the second bar 48. The gripping member 31 and the fourth additional gripper 32*d* are opened and closed by means of relative displacement of the bars 47, 48 in the longitudinal direction thereof. In the shown embodiment, the bars 47, 48 have been displaced such that the gripping member 31 and the fourth additional gripper 32*d* have been closed, i.e. the pairs of jaws have been moved against each other, thereby pinching the upper back portion 15 of the packages 1.

A gas sealing unit 36 is integrated in the gripping member 31 for provision of the second seal 17 entrapping gas introduced into the handle compartment 7. To this end, the gas sealing unit 36 comprises a second sealing member 37 arranged in the first jaw 38 of the gripping member 31.

More specifically, the first jaw 38 of the gripping member comprises a thermally non-conductive engagement member 40 which is movable against the second jaw 39 in order to pinch the package 1. The second sealing member 37 is recessed in an engagement surface 41 of the engagement member 40, which may be clearly seen in FIGS. 4 and 5. In those figures it may also be seen that a section of the engagement surface 41 adjoining the second sealing member 37 forms a first engagement portion 49 which faces the pressurized side of the gas filled handle compartment 7 when the first and second jaws 38, 39 are brought together and the second sealing member 37 engages the package 1 in order to provide the second seal 17. The non-heated first engagement portion 49 will thus relieve the second seal 17 while it is being formed and thus ensuring that it will not be exposed to the gas pressure which in turn minimizes the risk for a failed seal.

As also seen in FIGS. 4 and 5, the engagement surface 41 of the engagement member 40 also comprises a non-heated second engagement portion 50 arranged for gripping the upper front portion 14 of a package (not shown) being handled in parallel with the shown package 1. The second jaw 39 will act as an abutment also for this second engagement portion 50.

It will be appreciated that the present invention is not limited to the embodiments shown.

For instance, the inventive apparatus may comprise a different set of stations. Also, two or more stations may be integrated in a single station. Thus, the sealing station and the gas filling station may be integrated in a single station. Further, two subsequent station may perform the same operation. Thus, the plurality of stations may comprise two filling stations and/or two sealing stations.

Several modifications and variations are thus conceivable within the scope of the invention which thus is exclusively defined by the appended claims.

The invention claimed is:

1. An apparatus for filling a pouch type package with a liquid product, the pouch type package comprising two flexible opposing side walls defining a product compartment communicating with the environment via a filling duct and a separate handle compartment communicating with the environment via a gas inlet arranged in one of the two side walls, wherein the product compartment is adapted to be filled with the liquid product through the filling duct and wherein the handle portion is adapted to be filled with gas through the gas inlet, the apparatus comprising a plurality of stations arranged to consecutively receive and handle the pouch type package, the plurality of stations comprising a filling station for filling the product compartment with the liquid product and comprising a filling tube insertable into the filling duct of the pouch type package, a sealing station for sealing the product compartment after having been filled with the liquid product and comprising a first sealing member arranged to provide the pouch type package with a first seal closing the filling duct, a gas filling station arranged to introduce gas into the handle compartment for inflation thereof and comprising a nozzle applicable over the gas inlet, and a transfer unit comprising a gripping member for retrieving the package from the gas filling station and transferring it to a neighboring down-stream situated station, characterized by a gas sealing unit integrated in and movable together with the gripping member of the transfer unit, the gas sealing unit comprising a second sealing member arranged to provide the pouch type package with a second seal entrapping gas introduced into the handle compartment.

2. The apparatus according to claim 1, in which the gripping member of the transfer unit comprises a pair of jaws arranged to pinch an upper portion of the pouch type package for retrieval thereof.

3. The apparatus according to claim 2, in which the pair of jaws of the gripping member comprises a first jaw having a thermally non-conductive engagement member, wherein the second sealing member is recessed in an engagement surface of the engagement member.

4. The apparatus according to claim 3, in which an engagement surface comprises a first engagement portion adjoining the second sealing member, the first engagement portion being arranged to face a pressurized side of the handle compartment while the second sealing member engages the package in order to provide the second seal.

5. The apparatus according to claim 3, wherein the transfer unit comprises an additional gripper arranged to transfer the pouch type package from a station situated up-stream or down-stream of the gas filling station to a neighboring down-stream situated station.

6. The apparatus according to claim 3, wherein the sealing station and the gas filling station are integrated in a single station.

7. The apparatus according to claim 3, in which each of the plurality of stations are arranged for parallel handling of a group of packages comprising at least two pouch type packages.

8. The apparatus according to claim 7, in which the gripping member of the transfer unit is arranged to grip an upper back portion comprising said gas inlet of the package as well as an upper front portion of a package being handled in parallel.

9. A method for filling a pouch type package with a liquid product, the pouch type package comprising two flexible opposing side walls defining a product compartment communicating with the environment via a filling duct and a separate handle compartment communicating with the environment via a gas inlet arranged in one of the two side walls, wherein the product compartment is adapted to be filled with the liquid product through the filling duct and wherein the handle compartment is adapted to be filled with gas through the gas inlet, the method comprising filling the product compartment with a liquid product at a filling station in which a filling tube is inserted into the filling duct of the pouch type package, providing the pouch type package at a sealing station with a first seal closing the filling duct, introducing gas into the handle compartment for inflation thereof at a gas filling station by means of a nozzle applied over the gas inlet of the pouch type package, and providing the pouch type package with a second seal entrapping gas which has been introduced into the handle compartment at the gas filling station, characterized by transferring the package from the gas filling station to a neighboring down-stream situated station, wherein the step of providing the pouch type package with a second seal is performed by means of a gas sealing unit integrated in and movable together with a gripping member of a transfer unit during the step of transferring the package from the gas filling station to the neighboring down-stream situated station.

10. The method according to claim 9, further comprising transferring the pouch type package with its product compartment filled with a liquid product from the filling station to the sealing station.

11. The method according to claim 9, further comprising transferring the package from a neighboring up-stream situated station to the gas filling station.

12. The method according to claim 11, wherein the neighboring up-stream situated station from which the pouch type package is transferred to the gas filling station is the sealing station.

13. The method according to claim 9, wherein the neighboring down-stream situated station to which the pouch type package is transferred from the gas filling station is an output station.

14. The method according to claim 9, wherein the second seal is provided such on the pouch type package that in extends across a third segment of the handle compartment, the third segment being arranged between a first segment of the handle compartment forming a handle in the inflated state of the handle compartment and a second segment comprising said gas inlet.

* * * * *